US007878800B2

(12) United States Patent
Bettinzoli

(10) Patent No.: US 7,878,800 B2
(45) Date of Patent: Feb. 1, 2011

(54) GAS BURNER WITH SEPARATE FEEDING OF THE FLAME CROWNS

(75) Inventor: Angelo Bettinzoli, Concesio (IT)

(73) Assignee: Sabaf S.p.A., Ospitaletto (IT)

( * ) Notice: Subject to any disclaimer, the term of this patent is extended or adjusted under 35 U.S.C. 154(b) by 935 days.

(21) Appl. No.: 10/534,493

(22) PCT Filed: Nov. 12, 2002

(86) PCT No.: PCT/IT02/00720

§ 371 (c)(1),
(2), (4) Date: Jun. 6, 2005

(87) PCT Pub. No.: WO2004/044490

PCT Pub. Date: May 27, 2004

(65) Prior Publication Data

US 2006/0121402 A1 Jun. 8, 2006

(51) Int. Cl.
*F23D 14/62* (2006.01)

(52) U.S. Cl. ..... 431/354; 431/266; 431/284; 126/39 E

(58) Field of Classification Search ..... 431/217, 431/354, 278, 285, 266, 284; 126/39 R, 126/39 J, 39 K
See application file for complete search history.

(56) References Cited

U.S. PATENT DOCUMENTS

| | | | | |
|---|---|---|---|---|
| 2,511,205 | A * | 6/1950 | Harper et al. | 431/194 |
| 2,511,208 | A * | 6/1950 | Hornung | 431/194 |
| 5,277,576 | A * | 1/1994 | Hartung et al. | 431/198 |
| 5,401,164 | A * | 3/1995 | Yen | 431/354 |
| 5,842,849 | A * | 12/1998 | Huang | 431/284 |
| 6,132,205 | A * | 10/2000 | Harneit | 431/354 |
| 6,318,993 | B1 * | 11/2001 | Huang | 431/354 |
| 6,325,619 | B2 * | 12/2001 | Dane | 431/284 |
| 7,001,176 | B2 * | 2/2006 | Bettinzoli | 431/354 |
| 2001/0010897 | A1 * | 8/2001 | Dane | 431/266 |
| 2004/0029063 | A1 * | 2/2004 | Bettinzoli | 431/354 |

FOREIGN PATENT DOCUMENTS

| | | | |
|---|---|---|---|
| DE | 4427953 | A1 * | 2/1996 |
| EP | 485645 | * | 11/1990 |
| EP | 0 485 645 | A1 | 5/1992 |
| EP | 634608 | A2 * | 1/1995 |
| EP | 0 903 538 | A1 | 3/1999 |

(Continued)

OTHER PUBLICATIONS

International Search Report for PCT/IT02/00720 mailed Mar. 12, 2003.

*Primary Examiner*—Kenneth B Rinehart
*Assistant Examiner*—Jorge Pereiro
(74) *Attorney, Agent, or Firm*—Nixon & Vanderhye P.C.

(57) ABSTRACT

A gas burner for cookers of the type fitted to a cooking hob includes a central body having a first flame distribution ring and at least one external body, fluidly separated from the central body and substantially concentric with it, having at least one second flame distribution ring. In addition, structure is provided for separately feeding the mixture of primary air and gas to the central body and to the external body. This structure includes at least one horizontal mixing chamber with a radial Venturi effect.

16 Claims, 7 Drawing Sheets

FOREIGN PATENT DOCUMENTS

| | | | | |
|---|---|---|---|---|
| FR | 1197178 | | | 11/1959 |
| FR | 2 650 369 | | | 2/1991 |
| WO | WO 9908046 | A1 | * | 2/1999 |
| WO | 02/02991 | A1 | | 1/2002 |
| WO | WO 02/02991 | | * | 1/2002 |

* cited by examiner

GAS BURNER WITH SEPARATE FEEDING OF THE FLAME CROWNS

This application is the U.S. national phase of international application PCT/IT2002/000720 filed 12 Nov. 2002 which designated the U.S., the entire content of which is hereby incorporated by reference.

FIELD OF THE INVENTION

The present invention refers to a gas burner for cookers, of the type fitted to a cooking hob, comprising a central body having a first ring of flames and at least one external body, fluidly separated from the central body and concentric with it, having at least one second ring of flames, as well as means for separately feeding the mixture of primary air and gas to the central body and to the external body.

PRIOR ART

These burners with several rings of flames (i.e. several flame crowns) for domestic use, which guarantee a more homogeneous distribution of the heat provided and therefore a more uniform heating of the pans on top in comparison with the usual burners with a single ring of flames, have been known since at least 1926, as described in the British patent publication GB 246.367 (Brostrom).

In this prior type of burners for domestic use, a single device is normally provided for mixing the primary air with the gas fuel, usually composed of a long vertical pipe with an axial Venturi effect (that is in which the expansion of the fluids takes place axially to the duct in which they flow), and a series of ducts for feeding the mixture of primary air and gas fuel to the various rings of flames of the burner.

It's known in the art, for example from the European patent application EP-A-0.903.538 in the name of the Applicant, to make burners with two or more rings of flames of the type indicated above, in which the device for mixing the primary air with the gas fuel, which also performs the function of giving said mixture of primary air and gas fuel an adequate pressure and speed for feeding to the same rings of flames, comprises a horizontal mixing chamber with a radial Venturi effect located in correspondence to the central body provided with holes for the above-mentioned first ring of flames.

The horizontal chambers with a radial Venturi effect, the use of which in domestic burners is for example known from the French patent FR 1.197.178 in the name of Hourdry, are generally composed of two substantially circular parallel walls, suitably distanced from each other, and of a circular hole for the inflow of the primary air and of the gas, made corresponding to the central area of the lower wall. The primary air and the gas encounter a narrow section composed of that circular ring of the chamber which extends above the inflow hole to the upper wall of the chamber itself, and then reach a uniformly enlarged section, composed of the portion of the horizontal chamber which surrounds the above-mentioned circular ring towards the outside, in which said gaseous fluids expand radially. The presence along the path of the fluids of a narrow section followed by a uniformly enlarged section generates a Venturi effect which results in a fall in the pressure of the fluids (and consequent increase of the speed) within the narrow section, to suck in the flow of primary air and the gas, and a mixing of the same fluids, once they have arrived in said uniformly enlarged section, when the pressure is recovered and their speed is decreased. The use of a similar horizontal mixing chamber with a radial Venturi effect allows the reduction in the dimensions of the height of the burner and, as shown by application EP-A-0.903.538, it can be effectively used in a burner with several rings of flames.

While guaranteeing homogeneous distribution of the heat supplied, (i.e reduced thermal gradients in correspondence to the same burner), the above-mentioned burners allow the regulation of the flow rate of the gas arriving at the burner, but do not allow a more accurate regulation of heat, which may be obtained with the separate use of the rings of flames.

However, it is often useful or necessary to be able to have this more sensitive gas. regulation in burners with multiple rings of flames. To satisfy this need, various technical solutions are known.

The international patent application WO 99/08046, in the name of Defendi, teaches how to make a gas burner with a central body having a first ring of flames and an annular external body comprising two concentric rings of flames. The central body and the annular external body are separately fed by means for mixing the gas with the primary air, consisting of pipes with an axial Venturi effect placed horizontally below the cooking hob. The flow of gas to the above-mentioned Venturi pipes is regulated by separate taps, so as to allow separate lighting of the rings of flames. This solution, which is quite common, while allowing limited bulk as regards the height of the burner, requires a considerable extension in the width of the same burner, due to the horizontal arrangement of the Venturi pipes, and the need to have a suitably shaped cooking hob.

The European patent application EP 0.485.645 (Miralfin) describes a burner with several rings of flames, in which these are separately fed so as to allow their independent lighting and operation. To guarantee a correct mixing of the primary air with the gas fuel and a suitable pressure for feeding this mixture in the burner, there are two long vertical pipes with an axial Venturi effect, respectively feeding one central ring of flames and one external ring of flames concentric with the central one. The supply of the primary air, moreover, is accomplished by taking air from below the cooking hob so as to avoid fluid-dynamic interferences with the flows of secondary air and with the rings of flames. The Miralfin solution involves a large height of the burner and the need to have cooking hobs with the possibility of an inflow of primary air from inside them.

The Italian patent IT 1.232.887 in the name of Merloni supplies a gas burner for domestic use comprising a central body with a first ring of flames and two semicircular external bodies having a second ring of flames facing outwards. The central body and the two external bodies are fluidly separated and separately fed by means of vertical pipes with a Venturi effect which take in primary air, mix it with the gas, and give the mixture the necessary pressure and speed conditions to distribute it correctly in the burner. The flow of gas to the Venturi pipes can be regulated by separate feeding taps.

The flow of primary air, which takes place above the cooking hob, is separate for the central body and for the two external bodies.

Moreover, to limit the height of the vertical Venturi pipes, and therefore of the burner, and at the same time guarantee the stability of the flame of the external ring, the Venturi pipes of the Merloni burner intended for feeding the external bodies present wedge-shaped caps positioned in correspondence to the outflow section of the same Venturi pipes.

This Merloni solution allows the burner height to be sufficiently limited and gives good burner efficiency.

However, the use of feeding means to the central body and to the two external semicircular bodies comprising vertical ducts with an axial Venturi effect has proven not to be very convenient because it requires careful sizing of the vertical pipes with an axial Venturi effect and particular precautions such as the use of wedge-shaped caps positioned in correspondence to the expansion section of the Venturi, in order to obtain an efficacious mixing of the primary air with the gas fuel and a sufficient diffusion of the mixture inside the external semicircular bodies without using excessively long vertical Venturi pipes to do this. The use of these shaped caps, however, increases the complexity of the burner and anyway involves an excessive, undesired height of the burner.

Moreover the Merloni patent teaches how to make two separate circuits for taking and distributing the primary air for the central body and for the two external bodies, thus increasing the difficulty of construction of the burner itself.

An aim of the present invention is to provide a gas burner for cookers, of the type fitted to a cooking hob, comprising a central body, with a first ring of flames, and at least one external body, having at least one second ring of flames, fed separately, which does not present the inconvenient aspects of the prior art.

Another aim of the present invention is to realise a gas burner for cookers, of the type fitted to a cooking hob, comprising a central body having a first ring of flames and at least one external body, separated from and concentric with said central body, having at least one second ring of flames, as well as means for separately feeding the mixture of primary air and gas to the central body and to the external body, which, ensuring optimum combustion efficiency and stability of the ring of flames, is particularly limited in height and simple to realise. A further aim of the present invention is to provide a gas burner for cookers equipped with several rings of flames which, being separately fed, allow extremely sensitive regulation of the heat supplied.

SUMMARY OF THE INVENTION

These and other aims of the present invention are achieved by the gas burner for cookers described in the first independent claim and in the subsequent dependent claims.

The gas burner for cookers, of the type fitted to a cooking hob, according to the present invention, comprises a central body having a first ring of flames (i.e. a first flame crown) and at least one external body, fluidly separated from the above-mentioned central body and substantially concentric with it, having at least one second (circumferential) ring of flames (i.e. at least one second circumferential flame crown), and. means for separately feeding the mixture of primary air and gas to the central body and to the external body. These means for feeding the external body comprise at least one horizontal mixing chamber with a radial Venturi effect.

The use of the horizontal mixing chamber with a radial Venturi effect as a means for feeding the ring or rings of circumferential flames involves not only a limitation of the height of the external body, and therefore of the burner when at the same time another radial Venturi is also applied to the central body, but also (and surprisingly) an efficacious mixing of the primary air with the gas fuel and an excellent subsequent distribution of the mixture of primary air and gas in the external body to feed the ring or rings of circumferential flames.

In a preferred embodiment of the present invention, the burner also comprises one or more inlets for the primary air situated above the cooking hob, and means for fluid connection of the primary air inlets with the above-mentioned means for separate feeding of the mixture of primary air and gas to the central body and to the external body. This means that it is not necessary to provide a cooking hob equipped with inlets for the inflow of primary air for use with the burner according to this embodiment of the present invention.

Advantageously, for the structural simplification that it allows, the above-mentioned means of fluid connection define a single circuit for the flow of primary air to the means for separate feeding of the mixture of primary air and gas.

According to a preferred embodiment of the present invention, in order to reduce the burner height, also the means for feeding the central body comprise a horizontal mixing chamber with a radial Venturi effect and moreover the upper wall of the mixing chamber in the external body and of the mixing chamber in the central body can be composed of a lower wall of top covering elements of the burner.

BRIEF DESCRIPTION OF THE DRAWINGS

Illustrated below, purely as examples, are some preferential embodiments of the present invention, with reference to the enclosed figures, in which.

DETAILED DESCRIPTION OF SOME PREFERRED EMBODIMENTS OF THE INVENTION

Figure 1A:
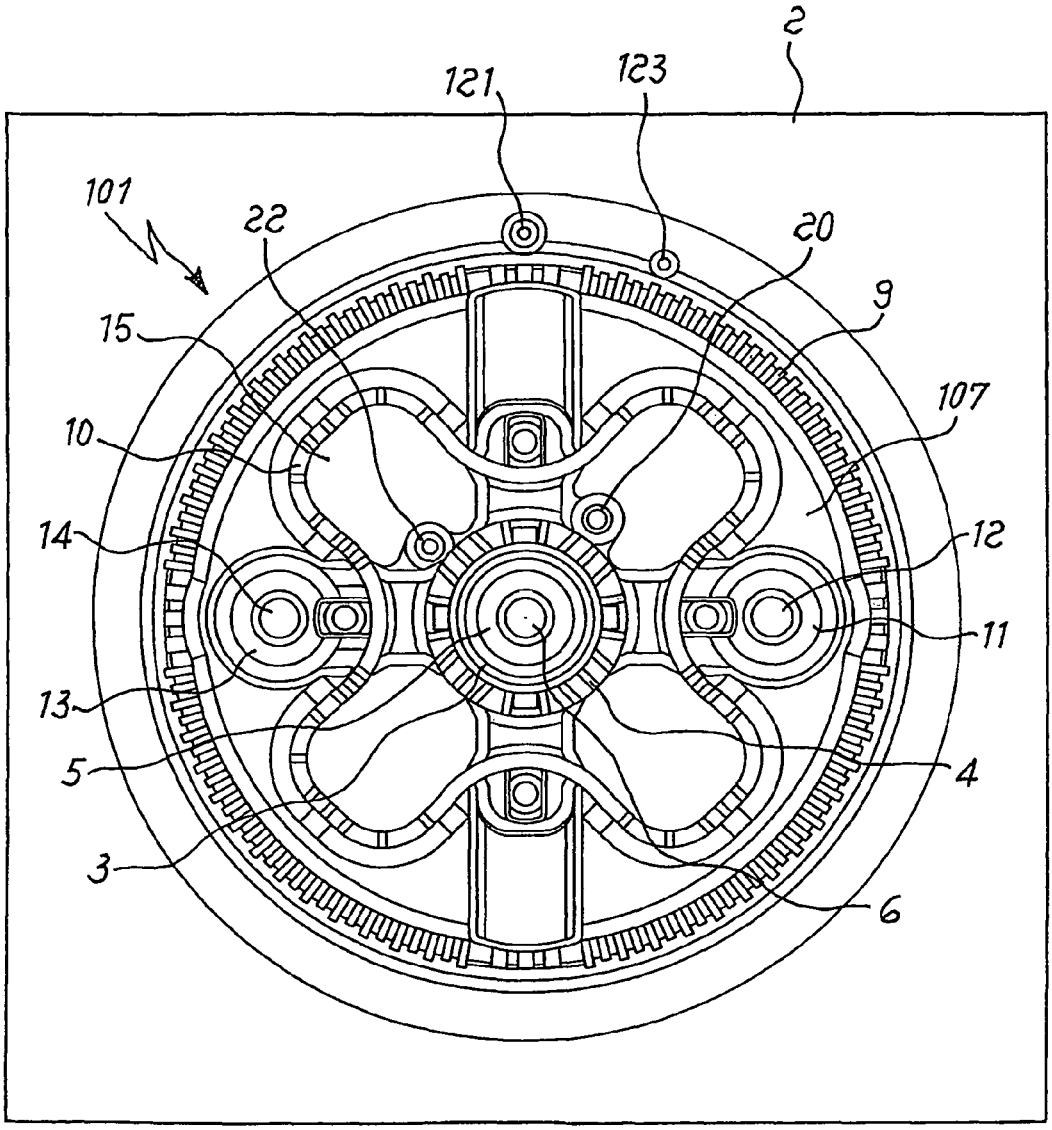
FIG. 1*a* is an overhead layout view of a gas burner for cookers, in a first embodiment of the present invention, without covering elements.

With reference to the enclosed figures, the gas burner 101 or 1 for cookers according to the present invention is of the type fitted to a cooking hob 2 and comprises, generally, a central body 3 having a first ring of flames 4 (defined by a plurality of flame holes according to the prior art and also known as flame crown) and at least one external body 107, 7, 8 having at least one second ring of flames (second flame crown) 9, 9*a*, 9*b* or 10, 10*a*, 10*b*. The external body 107, 7, 8 is fluidly separated from the central body 3 and is substantially concentric with the latter.

The burner 101, 1 also comprises means 5, 6, 29, 28, 33, 36 and 11, 12, 25, 27, 32, 13, 14, 24, 26, 34, 35 for separately feeding the mixture of primary air and gas to the central body 3 and to the external body 107 or 7, 8. The means 11, 12, 25, 27, 32, 13, 14, 24, 26, 34, 35 for feeding said external body 107 or 7, 8 also comprise at least one horizontal chamber 11, 12, 25 or 13,14, 24 with a radial Venturi effect.

Figure 1B:
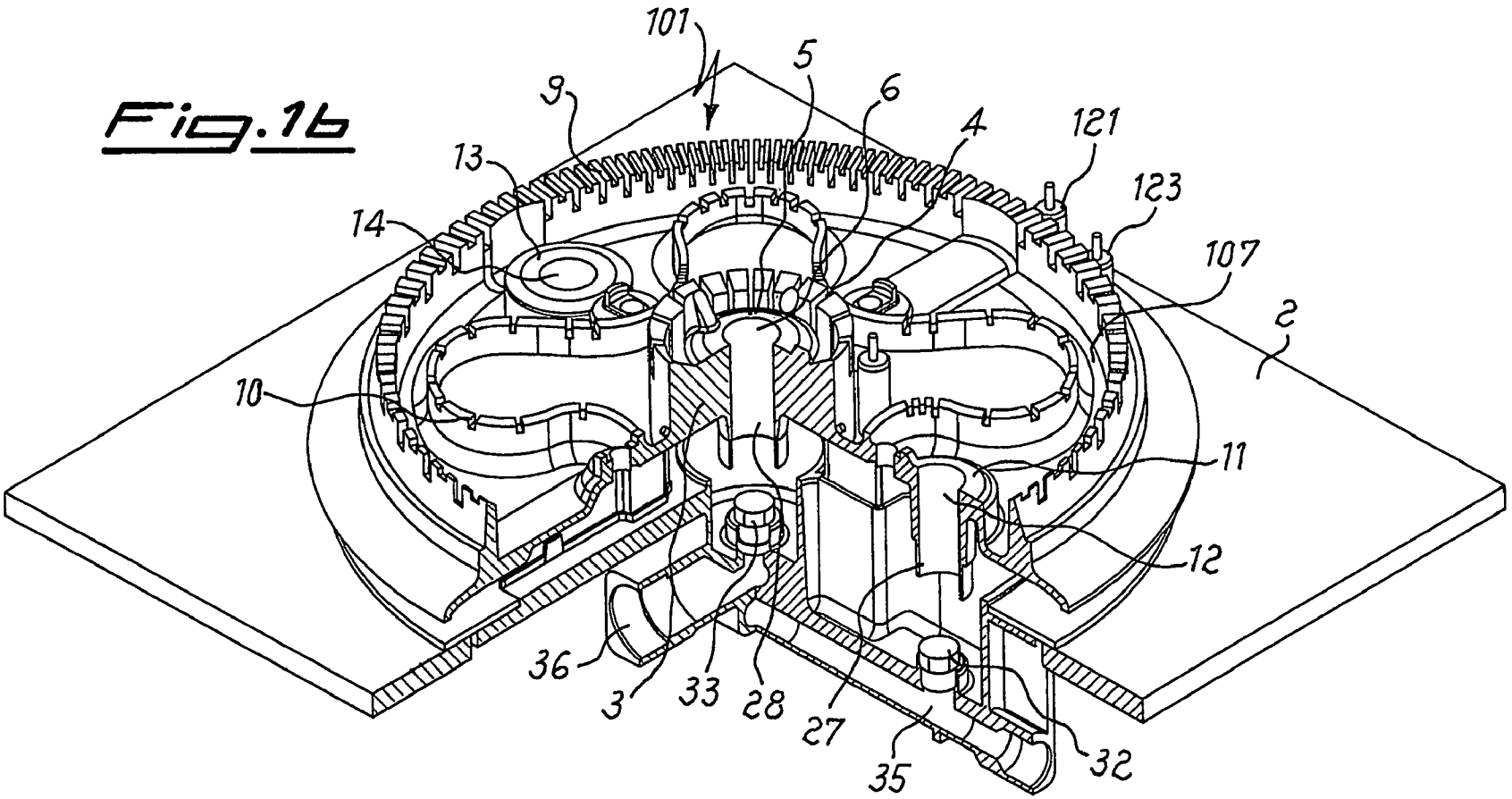
FIG. 1*b* is a partly sectioned perspective view of the burner in FIG. 1*a*, without covering elements.
Figure 2:
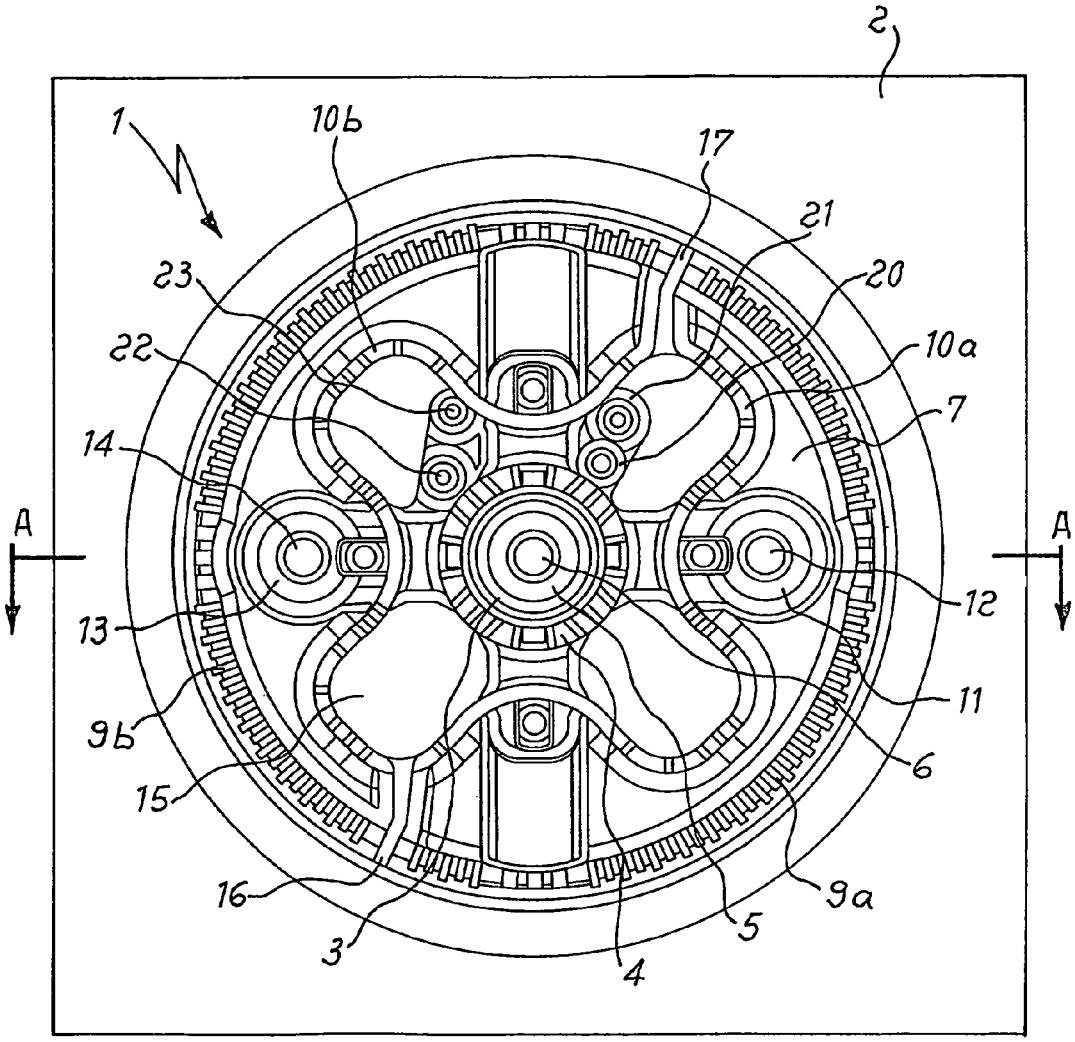
FIG. 2 is an overhead layout view of a burner in a second embodiment of the present invention without top covering elements.
Figure 3:
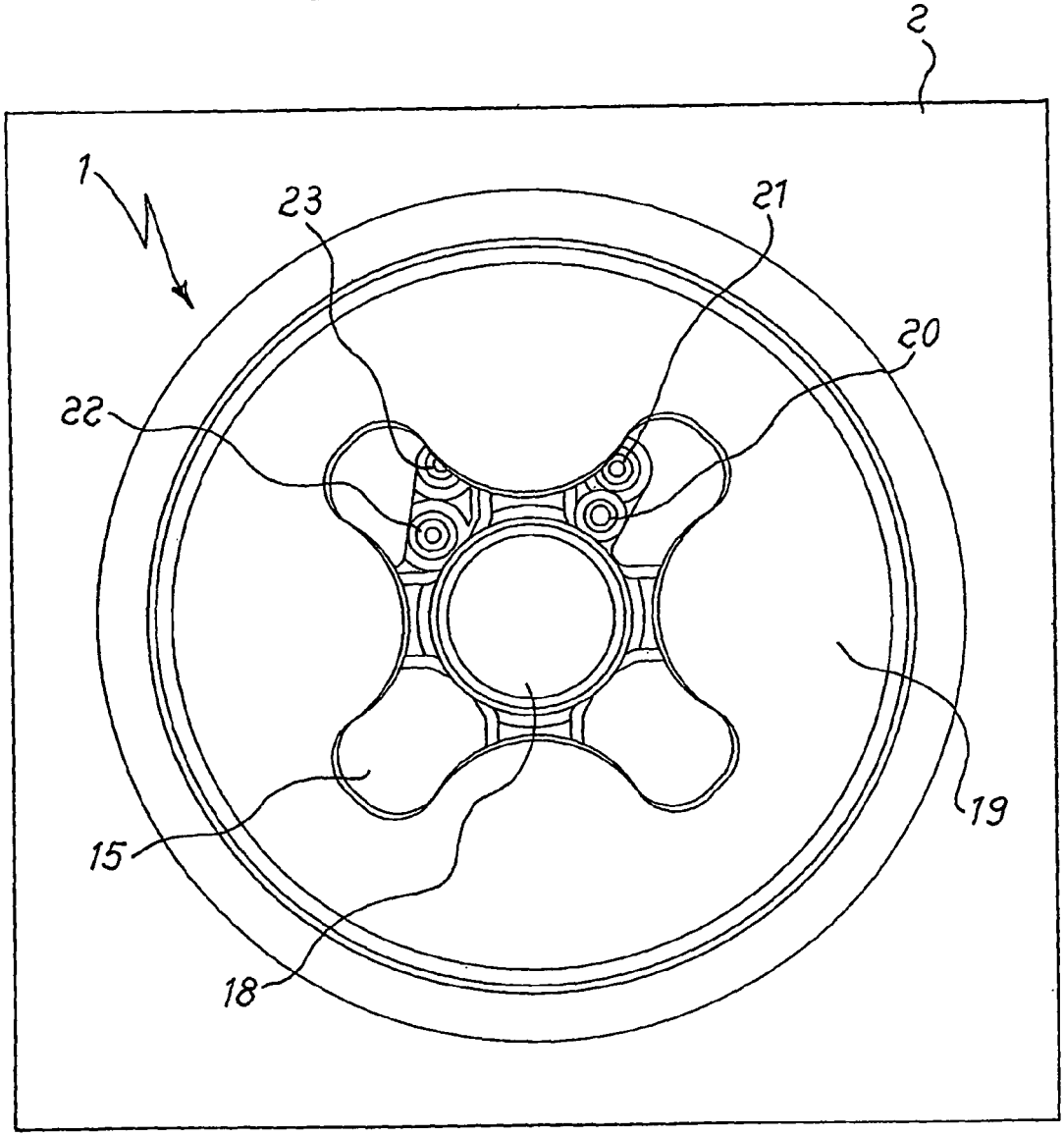
FIG. 3 is an overhead layout view of the burner in FIG. 2, with the top covering elements.

With reference, in particular, to the embodiment illustrated in FIGS. 1*a* and 1*b*, the burner 101 comprises a central body 3, with a central ring of flames 4 and a horizontal chamber 5, 6 with a radial. Venturi effect for the mixing and distribution of the primary air and of the gas fuel, and an annular external body 107, substantially concentric with said central body 3. The external body 107 is provided with two concentric rings of circumferential flames, respectively internal 10 and external 9, and with two horizontal chambers 11, 12 and 13, 14 with a radial Venturi effect for mixing the gas fuel with the primary air and distributing the mixture thus obtained inside the same external annular body 107.

The chambers with a radial Venturi effect 11, 12 and 13, 14 of the external body 107 are fed by their own pipe 35 for supplying gas fuel equipped with its own tap (not shown), separately from the chamber with a radial Venturi effect 5, 6 of the central body 3, which is in turn equipped with its own pipe 36 for supplying gas fuel.

In particular, the supply pipe 35 of the external body 107 feeds the gas fuel to ejectors located in correspondence to each chamber with a radial Venturi effect 11,12 and 13, 14, each of which is fluidly connected to a vertical duct, of which the top end section coincides with the inlet section in the respective chamber with a radial Venturi effect. In the section in FIG. 1*b* it is possible to see the ejector 32 and the vertical duct 27 (which as can be seen does not contribute to the establishing of the Venturi effect) operatively associated with the chamber with a radial Venturi effect 11, 12.

Similarly, the pipe 36 that feeds the gas fuel to the central body 3 of the burner is placed in fluid communication with an ejector 33 which sends the gas fuel into a vertical duct 28 (with no influence on the establishing of the radial Venturi effect), the top section of which coincides with the inlet section 6 of the gas and of the primary air into the chamber with a radial Venturi effect 5, 6 for mixing the gas with the primary air and distributing said mixture inside the same central body 3 to the ring of flames 4.

The inner circumferential ring of flames 10 of the external body 107 is placed, surrounding it, in front of the ring of flames 4 of the central body 3, so that between the two rings of flames 4 and 10 there is a region 15 separating the central body 3 from the external body 107. The rings of flames 4, 9 and 10, each of which is clearly provided with a plurality of flame holes, are thus substantially concentric with each other.

The region 15 is also suitably shaped to allow an effective flow of the secondary air (that is the environmental air which allows the combustion of the mixture of primary air and gas supplied to the flame holes) to the two rings 4 and 10, that is the profile followed by the internal circumferential ring 10 presents a plurality of cavities which give the region 15 a four-lobed conformation, in the plane.

For the ignition and the control of the ignition of the various rings of flames there are respectively ignition plugs 20, 121 and thermocouples 22, 123. Thanks to the separate feed of the chambers with a radial Venturi effect in the central body 3 and in the external body 107, and to the arrangement of said ignition plugs and thermocouples, the burner 101 can be activated in such a way that the rings of flames 9, 10 of the external body 107 are lit separately from the ring of flames 4 of the central body 3.

According to a preferred aspect of the invention, as will be pointed out with reference also to the subsequent embodiment of the burner according to the present invention, the central body 3 and the annular external body 107, though fluidly separate, are made in a single piece so that the burner 101 is composed of only three or four parts: a bottom container, for being fixed to the cooking hob 2, a top piece on which are obtained the bodies 3 and 107, and one or two covering elements of said bodies 3 and 107, in the case respectively of a single cover or of separate covers for the chambers defined by the bodies 3 and 107.

In the preferred embodiment illustrated in FIGS. 2-6, the same reference numbers have been used for identical parts. The burner 1 in FIGS. 2-6 comprises, unlike the burner in FIG. 1, two external bodies 7' and 8, substantially concentric with the central body 3, which are fluidly separate from each other, and each of which presents an external circumferential half-ring of flames, respectively indicated with 9*a* and 9*b*, and a internal circumferential half-ring of flames 10*a* and 10*b*. The internal circumferential ring of flames, defined by the half-rings 10*a*, 10*b*, is opposite to the central ring of flames 4 of the body 3. The region 15 that separates the central body 3 and the external circumferential bodies 7, 8 is shaped in such a way as to improve the flow of secondary air towards the ring of flames 4 and towards the same internal circumferential ring of flames 10*a*, 10*b*.

Between the separate external bodies 7 and 8 there may also be slots 16, 17 which have the function of allowing the ignition of the external circumferential ring of flames 9*a*, 9*b*, in the case where an ignition plug 20 is provided which concerns only the internal circumferential ring of flames 10*a*, 10*b*.

The external bodies 7 and 8 and the central body 3, though being fluidly separate, can be obtained, according to a preferred aspect of the present invention, in a single piece and are supported by a supporting bottom container 31 (FIG. 4), fixed to the cooking hob 2 according to the prior art.

Each separate external body 7 and 8 of the burner 1 is fed with the mixture of primary air and gas fuel thanks to a horizontal mixing chamber with a radial Venturi effect (also defined briefly below as radial Venturi), respectively 11, 12, 25 and 13, 14, 24.

Figure 4:
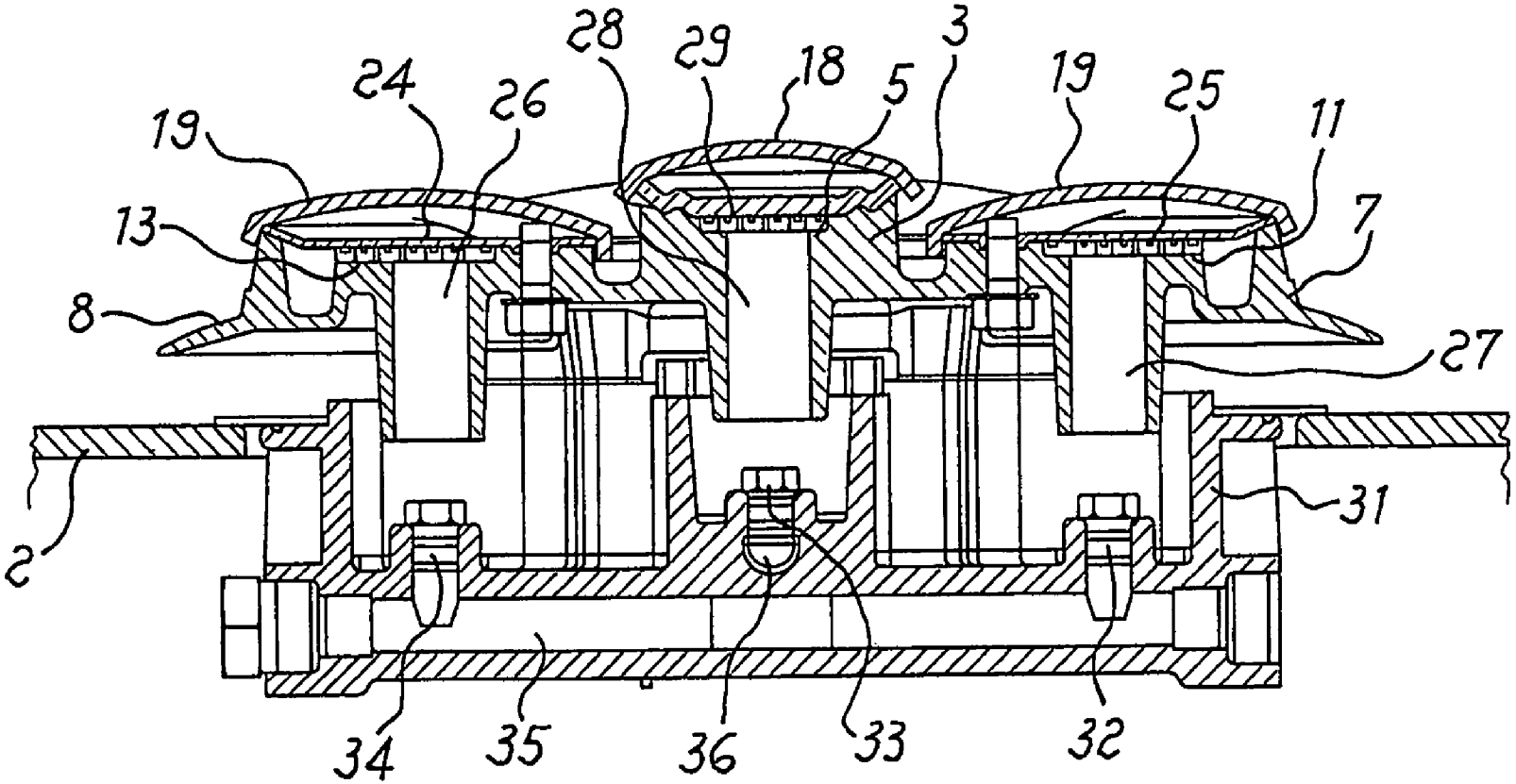
FIG. 4 is a sectioned side view of the burner in FIG. 2, taken along the line A-A in FIG. 2.
Figure 6:
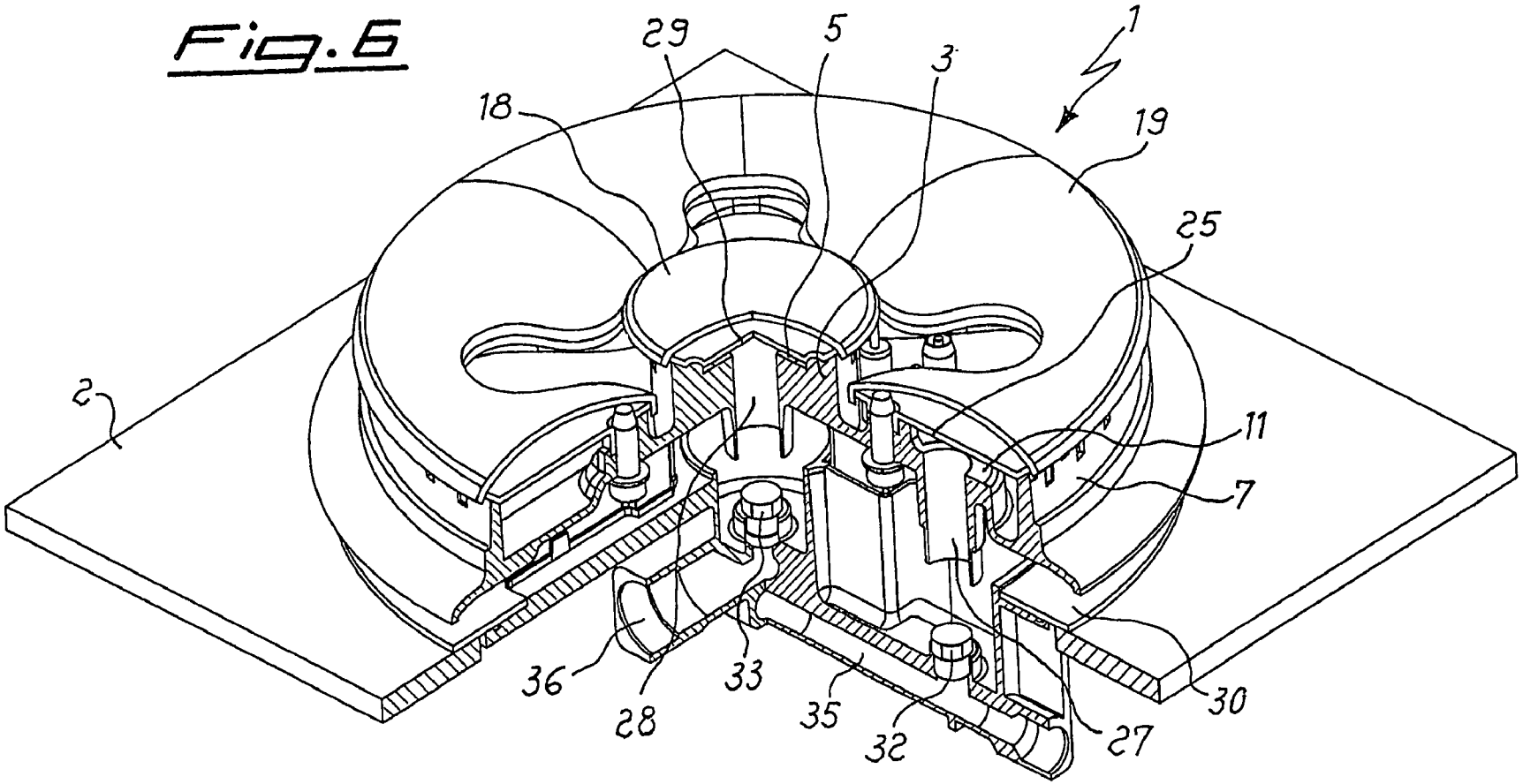
FIG. 6 is a partly sectioned perspective view of the burner in FIG. 5 with the top covering elements.

In greater detail, as shown in FIG. 4 and in FIG. 6, the radial Venturi of the external circumferential body 7 is defined by a horizontal flat lower wall 11, having a circular plan, by a horizontal flat upper wall 25, belonging to a top covering element 19 of the external bodies 7, 8 by the burner 1 and parallel to the wall 11, and by the hole 12, for inflow of the gas fuel and of the primary air (that is of the quantity of air, less than the quantity necessary for combustion, which is mixed with the gas fuel before combustion itself), obtained centrally on (and concentric with) the same lower wall 11. The horizontal lower wall 11, in the particular embodiment shown of the present invention, is obtained as a single piece in the external body 7.

Similarly, the radial Venturi of the other external circumferential body 8 of the burner 1 is defined by the parallel horizontal flat lower wall 13, obtained as a single piece in the body 8, and upper wall 24, belonging to the covering element 19, and by the hole 14, made in the lower wall 13.

Figure 5:
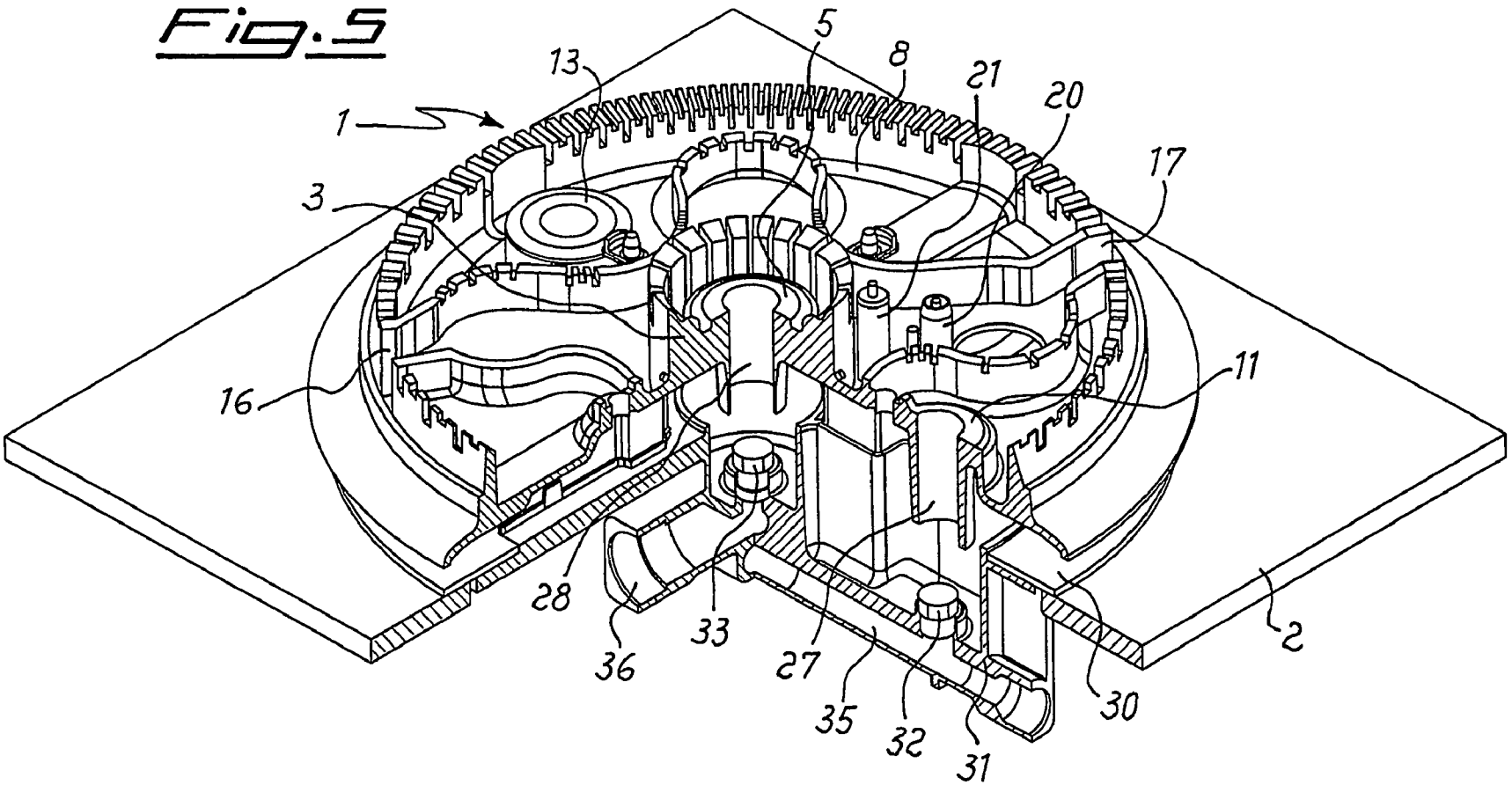
FIG. 5 is a partly sectioned perspective view of the burner in FIG. 2, without top covering elements.

As shown in detail in FIGS. 4, 5 and 6, the inflow hole 12 of the radial Venturi 11, 12, 25 of the body 7 and the inflow hole 14 of the radial Venturi 13, 14, 24 of the body 8 define respectively the top ends of the ducts 27 and 26, which constitute the respective inlet sections of said radial Venturis 11, 12, 25 and 13, 14, 24.

These vertical ducts 27, 26, which do not determine the establishing of the Venturi effect in the chambers 11, 12, 25 and 13, 14, 24, may be reduced in height so as to obtain external bodies 7 and 8 with an extremely reduced height.

In the ducts 27 and 26 flow both the gas fuel, coming respectively from the ejectors 32, 34, and the primary air taken from above the cooking hob 2, thanks to inlets, schematically indicated with the reference number 30, and to means of fluid connection of these inlets 30 with the ducts 27 and 26, and then with said radial Venturis. The ejectors 32, 34, according to a particular aspect of the present invention, are both in fluid connection with a pipe 35 that supplies gas fuel, the flow rate of which can be regulated by a corresponding tap (not illustrated).

The supply pipe 35, the ejectors 32, 34, the vertical ducts 26, 27 and the radial Venturis 11, 12, 25 and 13, 14, 24 constitute said means for feeding the external bodies 7 and 8 separately from the central body 3.

In alternative embodiments of the present invention, not illustrated, the burner 1 could present a single external body concentric with the central body 3 equipped with one or more radial Venturis inside it. Or the external bodies 7 and 8 of the burner 1 shown could, in turn, be fed separately.

According to another preferential aspect of the present invention, the burner 1 is also equipped with means for feeding the central body 3 separately from the external bodies 7 and 8 comprising a horizontal mixing chamber 5, 6, 29 with radial Venturi effect, defined by a flat lower wall, with a substantially circular base, 5, by a flat upper wall 29, parallel to the lower wall 5, and by an inflow hole 6 made in a central position and concentrically situated on the flat circular lower wall 5. According to a peculiar aspect of the present invention, the lower wall 29 of the radial Venturi 5, 6, 29 is a lower surface of a top covering element 18 of the central body 3, and the circular lower wall 5 is made in a single piece with the same central body 3.

The inflow hole 6 of the primary air and of the gas fuel is the top end of a vertical duct 28, which performs the function of the inlet section of the radial Venturi 5, 6, 29. This vertical duct 28 may have extremely small dimensions, since it is not essential for the establishing of the radial Venturi effect in the chamber 5, 6, 29.

The duct 28 is placed in fluid communication with an ejector 33 of the gas fuel and with a primary air feeding circuit, the inlets of which, located above the cooking hob 2, are briefly indicated with the reference number 30. The ejector 33 of the gas fuel is in turn in fluid connection with a gas fuel supply pipe 36 which can be connected to a tap (not shown) for regulating the gas flow rate.

The pipe 36, the ejector 33, the duct 28, the radial Venturi 5, 6, 29 constitute the above-mentioned means for feeding the central body 3 of the burner 1 separately from the external bodies 7 and 8.

According to a particularly advantageous aspect of the present invention, the means of fluid connection which connect the primary air inlets 30 with the means for separate feeding of the central body 3 and of the external bodies 7 and 8, define a single circuit supplying the primary air to the means for separate feeding of the mixture of primary air and gas. This allows a certain structural simplification of the burner 1.

The simultaneous presence of a radial Venturi 5, 6, 29 in the means for feeding the central body 3 and of at least one radial Venturi 11, 12, 25 or 13, 14, 24 in the means for feeding the external bodies 7 and 8, makes it possible to obtain a burner with several rings of flames with a particularly limited height, while ensuring that the feeding of the mixture of primary air and gas fuel to the external bodies 7, 8, and therefore to the circumferential ring or rings of flames 9*a*, 9*b*, 10*a*, 10*b*, is sufficient to obtain a stable flame in almost any external environmental condition.

In preferred embodiments of the present invention, the tap for regulating the feeding pipe 36, which controls the flow of gas to the radial Venturi 5, 6, 29 and therefore the power supplied by the ring of flames 4 of the central body 3, and the tap on the feeding pipe 35, which regulates the flow of gas to the radial Venturi 11, 12, 25 and 13, 14, 24 of the external bodies 7 and 8 of the burner 1 and therefore the power supplied by the rings of flames 9*a*, 9*b* and 1O*a*, 10*b*, may be separately activated. In other embodiments of the present invention, however, the two taps on the feeding pipes 35, 36 can be activated jointly.

Moreover, as already mentioned, the burner 1 comprises two separate top covering elements 18 and 19 for the central body 3 and for the two external bodies 7 and 8, but in alternative embodiments only one covering element could be present for the bodies 3 and 7, 8 of the burner 1, or a plurality of covering elements for each fluidly separate body 3, 7 and 8 of the same burner 1.

As already mentioned above, the realisation of the bodies 3, 7, 8, in a single part, though fluidly separated, allows the number of components of the burner 1 to be limited, so that it is composed of the bottom container 31, of the part comprising the bodies 3, 7 and 8 and of the top covering elements 18 and 19, and allows the assembly of the same burner 1 to be made easier.

In the case of a single covering element for the bodies 3, 7 and 8, this simplification of the burner 1 is increased, even if the use of two separate covering elements 18, 19 is preferred on account of the greater ease of realisation of the same covering elements 18, 19. Also represented in FIGS. 2-6 are the ignition plugs 20 and 21, respectively for the ring of flames 4 of the central body 3 and for the rings of flames 9*a*, 9*b*, 10*a*, 10*b* of the external circumferential bodies 7, 8, as well as the safety thermocouples 22 and 23.

The external bodies 7 and 8 of the burner 1 illustrated also have an outline, in plan, comprising a plurality of cavities which give the region 15 that separates the body 3 from the external bodies 7 and 8 a multi-lobed shape. This conformation of the external bodies 7, 8, has proved to be particularly advantageous because it allows the easy realisation, in the same external bodies 7, 8, of the radial Venturis 11, 12, 25 and 13, 14, 24 and at the same time ensures an optimum flow of secondary air into the region 15 directed towards the rings of flames 4 and 1O*a*, 10*b*.

During operation of the burner 1 illustrated, the user can decide to light only the ring of flames 4 of the central body 3, making the gas fuel flow from the pipe 36 into the ejector 33 and from there into the radial Venturi 5, 6, 29, or only the circumferential rings of flames 9*a*, 9*b*, 1O*a*, 10*b*, allowing the flow of gas from the pipe 34 to the ejectors 32 and 33 into the radial Venturis 11, 12, 25 and 13, 14, 24, or even all the rings of flames 4, 9*a*, 9*b*, 10*a*, 10*b* of the burner 1, depending on the required heating power and on the desired distribution of the flames under the cooking pan.

For example, turning the regulating tap of the pipe 36 that supplies gas to the ejector 33 causes gas to flow into the vertical duct 28 and from there, through the hole 6, into the horizontal chamber 5, 6, 29, where the radial Venturi effect takes place. The vacuum created in the annular ring of the chamber 5, 6, 29 situated in correspondence to the inflow hole 6 (narrow section of the radial Venturi) causes the intake of primary air, coming from the inlets 30, into the duct 28 and from there into the chamber 5, 6, 29. The subsequent radial expansion of the fluids (with increase of the pressure and decrease of the speed of the same fluids) in the chamber 5, 6, 29, or rather in the circular ring radially external to said narrow section of the radial Venturi, causes the mixing of the primary air and of the gas and its feeding to the ring flames 4.

A similar process takes place in the radial Venturis of the external bodies 7 and 8, when these are fed by the user.

The invention claimed is:

1. Gas burner for cookers comprising a central body, having a first flame distribution ring, and at least one external body, fluidly separated from said central body and substantially concentric with it, having at least one second flame distribution ring, as well as at least one horizontal mixing chamber with a radial Venturi effect to separately feed the mixture of primary air and gas to said central body and to said at least one external body, wherein said horizontal mixing chamber is formed by top and bottom horizontal walls, the bottom wall being having an inflow hole at a central portion thereof such that the primary air and gas flow from the inflow hole radially and generally parallel to the top and bottom horizontal walls.

2. Gas burner according to claim 1, further comprising a duct which is positioned upstream of the horizontal mixing chamber, which duct does not contribute to the radial Venturi effect.

3. Gas burner for cookers, of the type fitted to a cooking hob, comprising a central body, having a first flame distribution ring, and at least one external body, fluidly separated from said central body and substantially concentric with it, having at least one second flame distribution ring, as well as means for separately feeding the mixture of primary air and gas to said central body and to said at least one external body, wherein said means for feeding the at least one external body comprises at least one horizontal mixing chamber with a radial Venturi effect, wherein said horizontal mixing chamber is formed by top and bottom horizontal walls, the bottom wall having an inflow hole at a central portion thereof such that the primary air and the gas flow from the inflow hole radially and generally parallel to the top and bottom horizontal walls.

4. Burner according to claim 3, further comprising one or more inlets for the primary air located above the cooking hob, and means of fluid connection of said one or more primary air inlets with said means for separately feeding the mixture of primary air and gas to said central body and to said at least one external body.

5. Burner according to claim 4, wherein said means of fluid connection define a single circuit supplying primary air to said means for separately feeding the mixture of primary air and gas.

6. Burner according to claim 3, wherein said means for feeding said central body comprise a horizontal mixing chamber with a radial Venturi effect.

7. Burner according to claim 3, wherein said horizontal mixing chamber with a radial Venturi effect of said means for feeding said at least one external body and/or of said means for feeding the central body are obtained in said at least one external body and/or in said central body.

8. Burner according to claim 3, wherein said means for feeding said at least one external body comprise two or more horizontal mixing chambers with a radial Venturi effect.

9. Burner according to claim 8, further comprising two or more external circumferential bodies, fluidly separated, each one of which comprises a horizontal mixing chamber with a radial Venturi effect.

10. Burner according to claim 3, wherein said at least one second flame distribution ring comprises two concentric flame distribution rings.

11. Burner according to claim 3, further comprising a top covering element of said at least one external body, an upper wall of said at least one horizontal mixing chamber with a radial Venturi effect of the means for feeding said at least one external body coinciding with a lower wall of said covering element.

12. Burner according to claim 3, further comprising a top covering element of said central body, the upper wall of said at least one horizontal mixing chamber with a radial Venturi effect of the means for feeding the central body coinciding with a lower wall of said covering element.

13. Burner according to claim 3, wherein said means for separately feeding the mixture of primary air and gas to said central body and to said at least one external body are respectively actuated by separate taps.

14. Burner according to claim 3, wherein the internal profile of said at least one external body presents, in plan, one or more cavities.

15. Burner according to claim 3, wherein said at least one external body and said central body are made in a single piece.

16. Burner according to claim 3, further comprising a duct which is positioned upstream of the horizontal mixing chamber, which duct does not contribute to the radial Venturi effect.

* * * * *